US010004950B1

(12) United States Patent
Kapheim et al.

(10) Patent No.: US 10,004,950 B1
(45) Date of Patent: Jun. 26, 2018

(54) STRING SUPPORT ASSEMBLY FOR A RACQUET

(71) Applicant: Wilson Sporting Goods Co., Chicago, IL (US)

(72) Inventors: Robert T. Kapheim, Chicago, IL (US); Hudson R. Vantrease, Chicago, IL (US)

(73) Assignee: Wilson Sporting Goods Co., Chicago, IL (US)

( * ) Notice: Subject to any disclaimer, the term of this patent is extended or adjusted under 35 U.S.C. 154(b) by 0 days. days.

(21) Appl. No.: 15/495,638

(22) Filed: Apr. 24, 2017

(51) Int. Cl.
*A63B 51/00* (2015.01)
*A63B 51/10* (2015.01)

(52) U.S. Cl.
CPC ..... *A63B 51/10* (2013.01)

(58) Field of Classification Search
CPC ..... A63B 51/00; A63B 51/10
See application file for complete search history.

(56) References Cited

U.S. PATENT DOCUMENTS 3,567,225 A 3/1971 Hollis
3,642,283 A 2/1972 Wilkens
3,884,467 A 5/1975 Sommer
3,930,648 A 1/1976 Brown
4,204,681 A 5/1980 Hall
4,220,335 A 9/1980 Nobbs
4,314,699 A 2/1982 Bayer
4,331,331 A 5/1982 Rodgers
4,614,626 A 9/1986 Frerking
4,697,811 A 10/1987 Muroi
4,765,620 A 8/1988 Janes
4,828,259 A 5/1989 Davis
4,889,337 A 12/1989 Todd
4,913,434 A 4/1990 Fischer
4,930,782 A * 6/1990 Sines ..... A63B 51/00 473/537
5,092,016 A 3/1992 Soong
5,102,132 A 4/1992 Chen
5,137,274 A 8/1992 Soong
5,255,912 A 10/1993 Tseng
5,257,781 A * 11/1993 Sines ..... A63B 49/022 473/539
5,280,907 A 1/1994 Liu
5,290,031 A 3/1994 Natsume
5,368,297 A 11/1994 Liu
(Continued)

*Primary Examiner* — Raleigh W Chiu
(74) *Attorney, Agent, or Firm* — Terence P. O'Brien

(57) ABSTRACT

A sports racquet for supporting at least one racquet string and including a frame and at least one string support assembly. The frame includes handle and head portions separated by throat tubes. The head portion has grommet holes, and includes top, bottom, first side and second side regions. The string support assembly includes a grommet structure and at least one bearing element. The grommet structure includes a strip and at least two barrels extending from the strip. Each barrel includes a string hole extending along an axis of the barrel, and extends through a separate one of the grommet holes. The bearing element is coupled to the grommet structure, and includes an upper portion having a grooved rim engaging the string and a deflectable lower portion having opposing cutouts. The support assembly is positioned at one or more of the top, bottom, first side and second side regions.

21 Claims, 11 Drawing Sheets

(56) References Cited

U.S. PATENT DOCUMENTS

| | | | | |
|---|---|---|---|---|
| 5,409,215 | A | 4/1995 | You | |
| 5,762,570 | A | 6/1998 | Shaw | |
| 5,772,540 | A | 6/1998 | Kuebler | |
| 5,944,624 | A | 8/1999 | Davis | |
| 5,944,625 | A | 8/1999 | Janes | |
| 5,993,337 | A | 11/1999 | Janes | |
| 6,050,909 | A | 4/2000 | Severa | |
| 6,074,315 | A | 6/2000 | Yimoyines | |
| 6,217,466 | B1 | 4/2001 | Yimoyines | |
| 6,254,499 | B1 | 7/2001 | Tarleton | |
| 6,319,158 | B1 | 11/2001 | Cheng | |
| 6,336,877 | B1 * | 1/2002 | Arroyo | A63B 51/00 473/521 |
| 6,527,656 | B1 | 3/2003 | Cheng | |
| 6,964,624 | B2 | 11/2005 | Shen | |
| 6,971,964 | B1 | 12/2005 | Bothwell | |
| 7,285,062 | B2 | 10/2007 | McMillan | |
| 7,887,444 | B1 | 2/2011 | Severa | |
| 9,821,197 | B2 * | 11/2017 | Bothwell | A63B 49/02 |
| 2002/0039937 | A1 | 4/2002 | Bothwell | |
| 2005/0148413 | A1 * | 7/2005 | Filippini | A63B 49/02 473/539 |
| 2009/0215558 | A1 * | 8/2009 | Bothwell | A63B 51/00 473/540 |
| 2009/0227403 | A1 * | 9/2009 | Chang | A63B 49/02 473/540 |
| 2011/0165975 | A1 * | 7/2011 | Bothwell | A63B 51/00 473/535 |
| 2012/0077630 | A1 * | 3/2012 | Bothwell | A63B 49/002 473/539 |
| 2014/0296006 | A1 * | 10/2014 | Bothwell | A63B 51/00 473/524 |
| 2016/0199702 | A1 * | 7/2016 | Bothwell | A63B 71/0622 473/524 |

* cited by examiner

STRING SUPPORT ASSEMBLY FOR A RACQUET

FIELD OF THE INVENTION

The present invention relates generally to a sports racquet. In particular, the present invention relates to racquet including a head portion having at least one string support assembly having a grommet structure and at least one bearing element.

BACKGROUND OF THE INVENTION

Sport racquets, such as tennis, racquetball, squash and badminton racquets, are well known and typically include a frame having a head portion coupled to a handle portion. The head portion supports a string bed having a plurality of main string segments interwoven with a plurality of cross string segments. Many racquets also include a throat portion positioned between and connecting the handle portion to the head portion. The typical string bed of a sports racquet includes a central region, that provides the most responsiveness, the greatest power and the best "feel" to the player, upon impact with a ball, and a peripheral region. The central region, commonly referred to as the "sweet spot," is typically defined as the area of the string bed that produces higher coefficient of restitution ("COR") values. A higher COR generally directly corresponds to greater power and greater responsiveness.

Generally speaking, the COR of a central region of a racquet will increase with increased string bed deflection and with increased dwell time. A string bed that can deflect more when impacting a ball can provide longer "dwell time", the duration of impact between the ball and the string bed upon impact. The increased "dwell time" improves not only the responsiveness of a racquet, but also its control, including the ability to impart spin on the ball.

Some existing racquets incorporate a larger sized hoop portion supporting a larger sized string bed (i.e., a larger head size) in an effort to increase the size of the string bed and the sweet spot. However, as the head size of a racquet increases, so does the polar moment of inertia of the racquet. A racquet with a higher polar moment of inertia can be more difficult to maneuver, particularly at the net or upon return of serve, than a racquet with a lower moment of inertia. Additionally, some users find large head racquets to be more difficult to swing than racquets with normal sized heads.

Other racquets have incorporated different head shapes in an effort to increase the length of certain main or cross string segments, without increasing the size of all of the main and cross-string segments. Although such designs can provide a more targeted approach to increasing the performance of the racquet, such designs can also result in an undesirable increase in the polar moment of inertia of the racquet. Further, such designs may also result in a head size that has an undesirable appearance, or an appearance that is markedly different from the look and design of traditional sport racquet designs.

Thus, there is a continuing need for a racquet having a string bed with an enlarged sweet spot and providing an increased "dwell time," without negatively effecting the overall performance of the racquet. It would be advantageous to provide a racquet with an enlarged sweet spot and an increased "dwell time" without increasing the polar moment of inertia of the racquet head and without negatively affecting the maneuverability of the racquet. It would also be advantageous to provide a means for targeting certain main and/or cross string segments in an effort to optimize the performance of a particular racquet design, without increasing the polar moment of inertia of the racquet head and without negatively affecting the maneuverability of the racquet. There is also a need for a racquet having a string bed with an enlarged sweet spot that is not a radical departure in look and design from traditional sport racquet designs.

SUMMARY OF THE INVENTION

The present invention provides a racquet string support assembly for a sports racquet. The sports racquet includes a frame having a plurality of grommet holes and at least one racquet string. The string support assembly includes a grommet structure and at least one bearing element coupled to the grommet structure. The grommet structure includes a first strip having a first inner surface for contacting the frame and a first outer surface, and at least two spaced-apart barrels extending from the first inner surface. Each barrel includes a first string hole extending along a longitudinal axis of the barrel. Each barrel configured to extend through a separate one of the grommet holes of the frame. The bearing element includes an upper portion having a curved grooved rim forming an arc for engaging a portion of the racquet string and a deflectable lower portion having a pair of opposing cutouts to facilitate deflection of the bearing element.

According to a principal aspect of a preferred form of the invention, a sports racquet for supporting at least one racquet string. The racquet includes a frame including a handle portion and a head portion separated by a pair of throat tubes, and at least one string support assembly. The head portion has a plurality of grommet holes, and includes a top region, a bottom region, a first side region and a second side region. The at least one string support assembly includes a grommet structure and at least one bearing element coupled to the grommet structure. The grommet structure includes a first strip having a first inner surface for contacting the frame and a first outer surface, and at least two spaced-apart barrels extending from the first inner surface. Each barrel includes a string hole extending along a longitudinal axis of the barrel. Each barrel is configured to extend through a separate one of the grommet holes of the frame. The bearing element includes an upper portion having a curved grooved rim forming an arc for engaging a portion of the racquet string and a deflectable lower portion having a pair of opposing cutouts to facilitate deflection of the bearing element. The at least one string support assembly is positioned at one or more of the top portion, the bottom portion, the first side portion and the second side portion of the head portion of the frame.

According to another principal aspect of a preferred form of the invention, a string support assembly is configured for attachment to a sports racquet having a yoke and a handle portion. The yoke includes a plurality of grommet holes and a top peripheral surface. The string support assembly and the yoke support a segment of 17 gage aramid fiber racquet string. The yoke, the string support assembly and the string segment are capable of being tested under a string deformation test using a universal test machine including a first support and a string clamp. The string support assembly includes a grommet structure and at least one bearing element coupled to the grommet structure. The grommet structure includes a first strip having a first inner surface for contacting the yoke and a first outer surface, and at least two spaced-apart barrels extending from the first inner surface. Each barrel includes a string hole extending along a longitudinal axis of the barrel. Each barrel is configured to extend through a separate one of the grommet holes of the yoke. The at least one bearing element includes an upper portion having a curved grooved rim forming an arc for engaging a portion of the racquet. When the string support assembly is engaged with the yoke and the string segment is routed through two of the spaced apart barrels and about the rim of one of the bearing elements, the handle portion is fixed to the first test support, the ends of the string segment are secured by the string clamp such that the string segment extends a length of 3 inches or 76.2 mm from the top peripheral surface of the yoke to the string clamp of the universal test machine, and the string segment is placed under tension by the universal test machine from a starting tension of 55 lbf to final tension of 95 lbf, the string segment extends by at least 0.75 mm.

This invention will become more fully understood from the following detailed description, taken in conjunction with the accompanying drawings described herein below, and wherein like reference numerals refer to like parts.

DETAILED DESCRIPTION OF THE PREFERRED EMBODIMENTS

Figure 1:
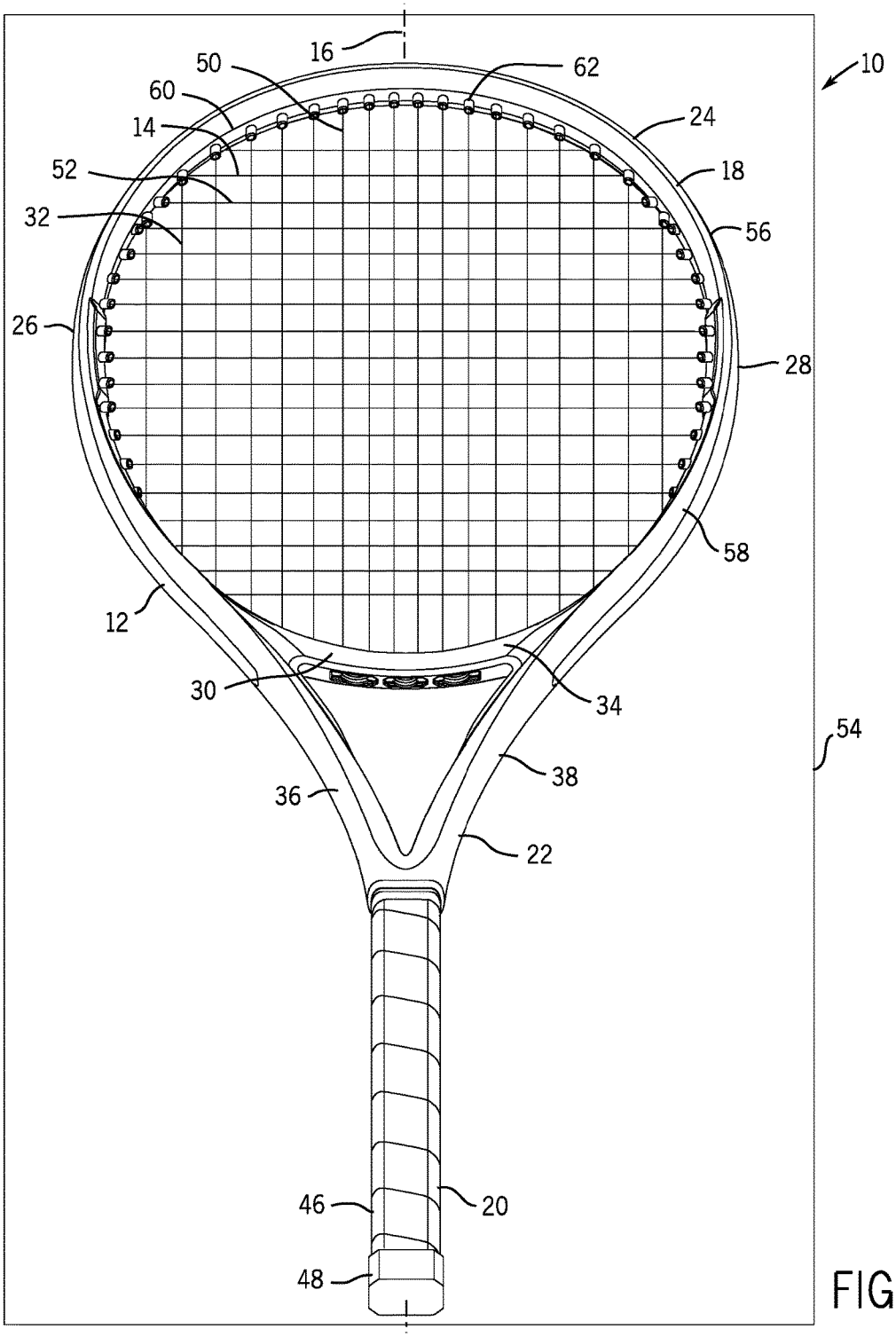
FIG. 1 is a front, bottom perspective view of a racquet in accordance with an implementation of the present invention.

Referring to FIG. 1, a sports racquet is indicated generally at 10. The racquet 10 of FIG. 1 is configured as a tennis racquet, however, the invention can also be formed as other types of sports racquets, such as, for example, a racquetball racquet, a squash racquet, or a badminton racquet. The racquet 10 includes a frame 12 and a string bed 14. The frame 12 is a tubular structure having a longitudinal axis 16 and including a head portion 18, a handle portion 20, and a throat portion 22 coupling the head and handle portions 18 and 20. The frame 12 is formed of a lightweight, durable material, preferably a fiber composite material. As used herein, the term "composite material" refers to a plurality of fibers impregnated (or permeated throughout) with a resin. The fibers can be co-axially aligned in sheets or layers, braided or weaved in sheets or layers, and/or chopped and randomly dispersed in one or more layers. The composite material may be formed of a single layer or multiple layers comprising a matrix of fibers with resin. In some implementations, the number layers can range from 3 to 8. In multiple layer constructions, the fibers can be aligned in different directions with respect to the longitudinal axis 16, and/or in braids or weaves from layer to layer. The fibers are formed of a high tensile strength material such as graphite. Alternatively, the fibers can be formed of other materials such as, for example, glass, carbon, boron, basalt, carrot, Kevlar®, Spectra®, poly-para-phenylene-2,6-benzobisoxazole (PBO), hemp and combinations thereof. In one set of implementations, the resin is preferably a thermosetting resin such as epoxy or polyester resins. In other implementations, the resin can be a thermoplastic resin. The composite material is typically wrapped about a mandrel and/or a comparable structure, and cured under heat and/or pressure. While curing, the resin is configured to flow and fully disperse and/or impregnate the matrix of fibers. In other implementations, the frame 12 can be formed of other materials including metallic alloys, other composite materials, wood, or combinations thereof.

The handle assembly 16 includes a handle 42, a pallet 44, a grip 46 (or grip tape), and a butt cap 48. The handle 42 is a rigid structure supporting or forming the pallet 44. In one implementation, the pallet 44 can be integrally molded into the handle 24 to define a rigid gripping member. In another implementation, the pallet 44 can be attached to a preformed handle. In an alternative implementation, the pallet is a separate component connected to a "hair-pin" shaped handle. In this limitation, the frame can be formed by one continuous tubular structure where both ends of the tube run side by side to form the hair pin handle.

Figure 2:
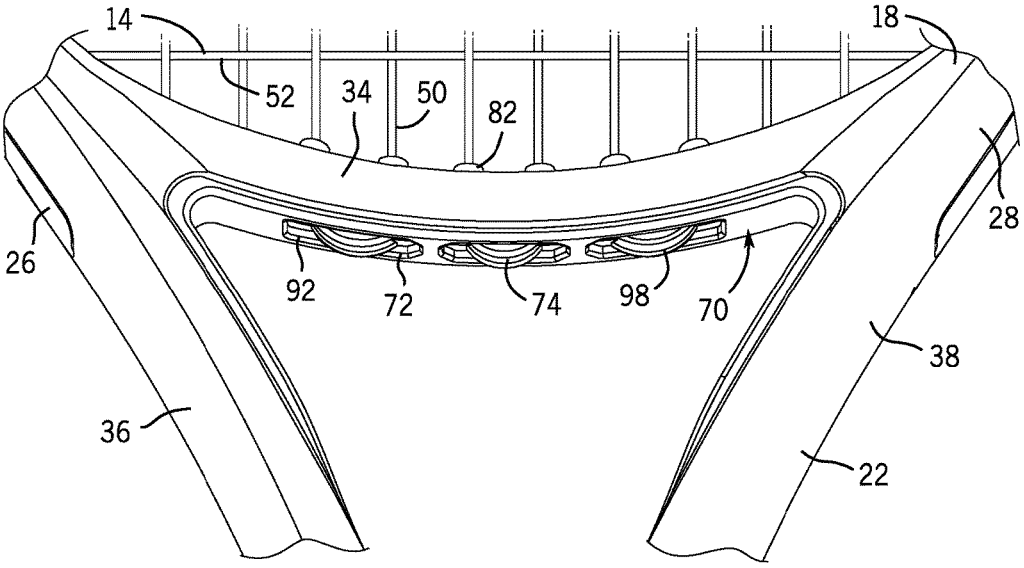
FIG. 2 is front perspective view of a yoke and throat portion of the racquet of FIG. 1.

Referring to FIGS. 1 and 2, the head portion 18 forms a distal or top region 24, first and second side regions 26 and 28, and a proximal region 30, which collectively define a string bed area 32 for receiving and supporting the string bed 14. In one preferred embodiment, the proximal region 30 which can also be referred to a yoke 34. The yoke 34 is an elongate tubular structural member which extends from the first side region 26 to the second side region 28 of the head portion 18 to form the proximal region 30 of the head portion 18 and to provide structural support to the frame 12. In one implementation, the yoke 34 is integrally formed with the frame 12 defining the proximal region 30. In other implementations, the yoke 34 can be connected through use of adhesives, fasteners, bonding and combinations thereof. In another implementation, the yoke 34 can separated from the frame 12 by vibration absorbing material, such as, for example, one or more elastomers. The yoke 34 is formed of a lightweight, durable material, preferably a carbon-fiber composite material. Alternatively, the yoke 34 can be formed of other materials, such as, for example, metallic alloys, other composite materials including basalt fibers, and combinations thereof.

In one implementation, the first and second side regions 26 and 28 downwardly extend from the head portion 18 to form first and second throat tubes 36 and 38 of the throat portion 22. The first and second throat tubes 36 and 38 can converge further downwardly extend to form the handle portion 20. In other implementations, the handle portion 20 can be a tubular structure that does not include an extension of the first and second throat tubes.

The string bed 14 is formed by a plurality of main string segments 50 interwoven with a plurality of cross string segments 52, and extends about a string bed plane 54. The main and cross string segments 50 and 52 can be formed from one continuous piece of racquet string, or from two or more pieces of racquet string.

The head portion 18 of the racquet 10 is preferably a tubular structure shaped to define a hoop 56. The hoop 48 can be any closed curved shape including, for example, a generally oval shape, a generally tear-drop shape, a generally pear shape, a generally circular shape and combinations thereof. The hoop 56 includes an outer peripheral wall 58 and an inner peripheral wall 60. In one implementation, the hoop 56 includes first and/or second groups of grommet openings 62 extending through the inner and/or inner peripheral walls 58 and 60, respectively.

Figure 3:
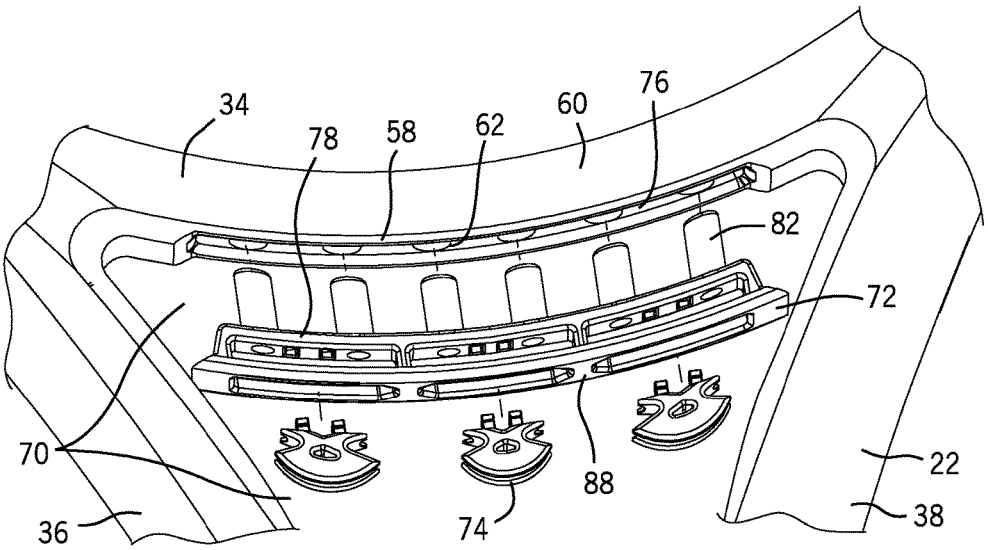
FIG. 3 is an exploded front perspective view of the yoke, the throat portion and a string support assembly of the racquet of FIG. 1.
Figure 4:
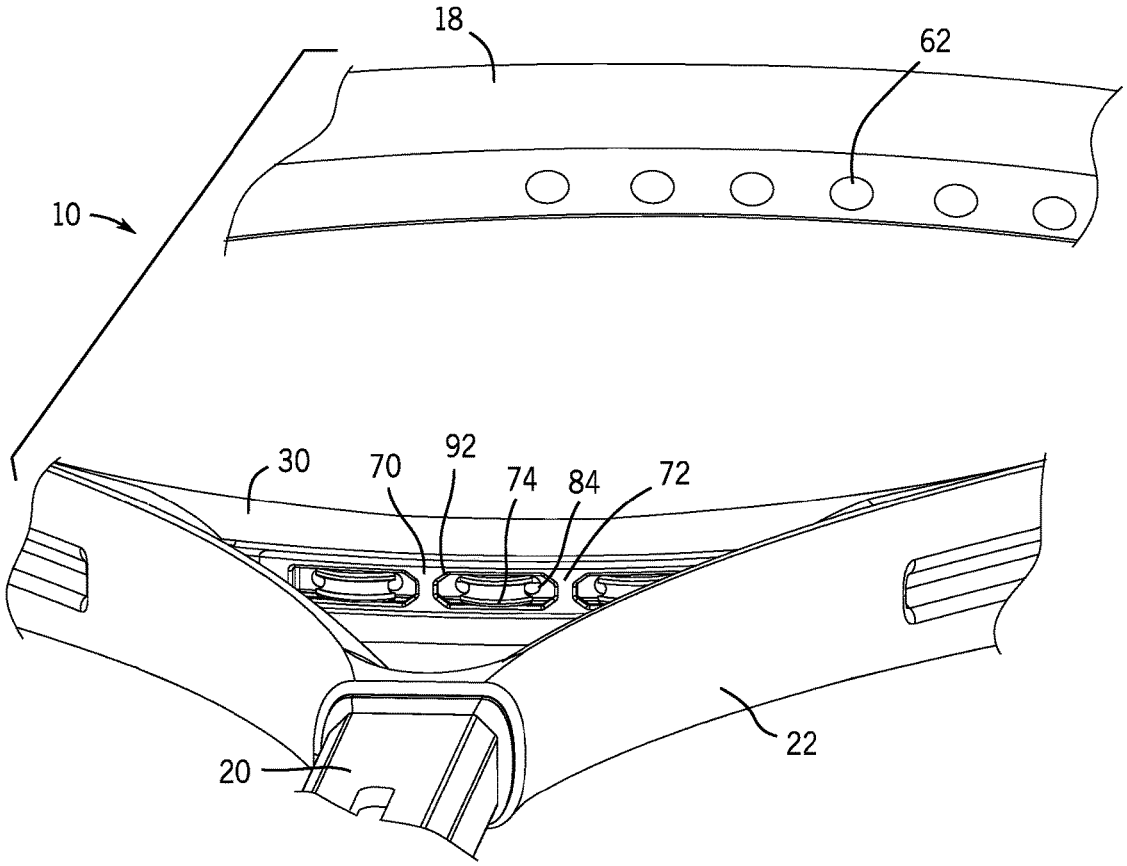
FIG. 4 is a bottom side sectional perspective view of a portion of the throat portion and the string support assembly the racquet of FIG. 1.

Referring to FIGS. 2 through 4, a string support assembly 70 in accordance with an implementation of the present invention is illustrated positioned at the proximal region 30 or yoke 34 of the head portion 18 of the racquet 10. The string support assembly 70 is a mechanism that enables the main string segments 50 of the string bed 14 supported by the assembly 70 to deflect more upon impact with a tennis ball than a racquet having a conventional grommet assembly. When the main string segments 50 supported by the assembly 70 are impacted by a ball, the deflection or compression of the string support assembly 70 allows the main string segments 50 to deflect to a greater extent thereby increasing the performance of the racquet 10. The string support assembly 70 includes a grommet structure 72 and three separate bearing elements 74 coupled to the grommet assembly 72. In other implementations, other numbers of bearing elements 74 can be used, such as one, two (FIG. 6*b*), four (FIG. 6*c*), five or more.

Figure 5:
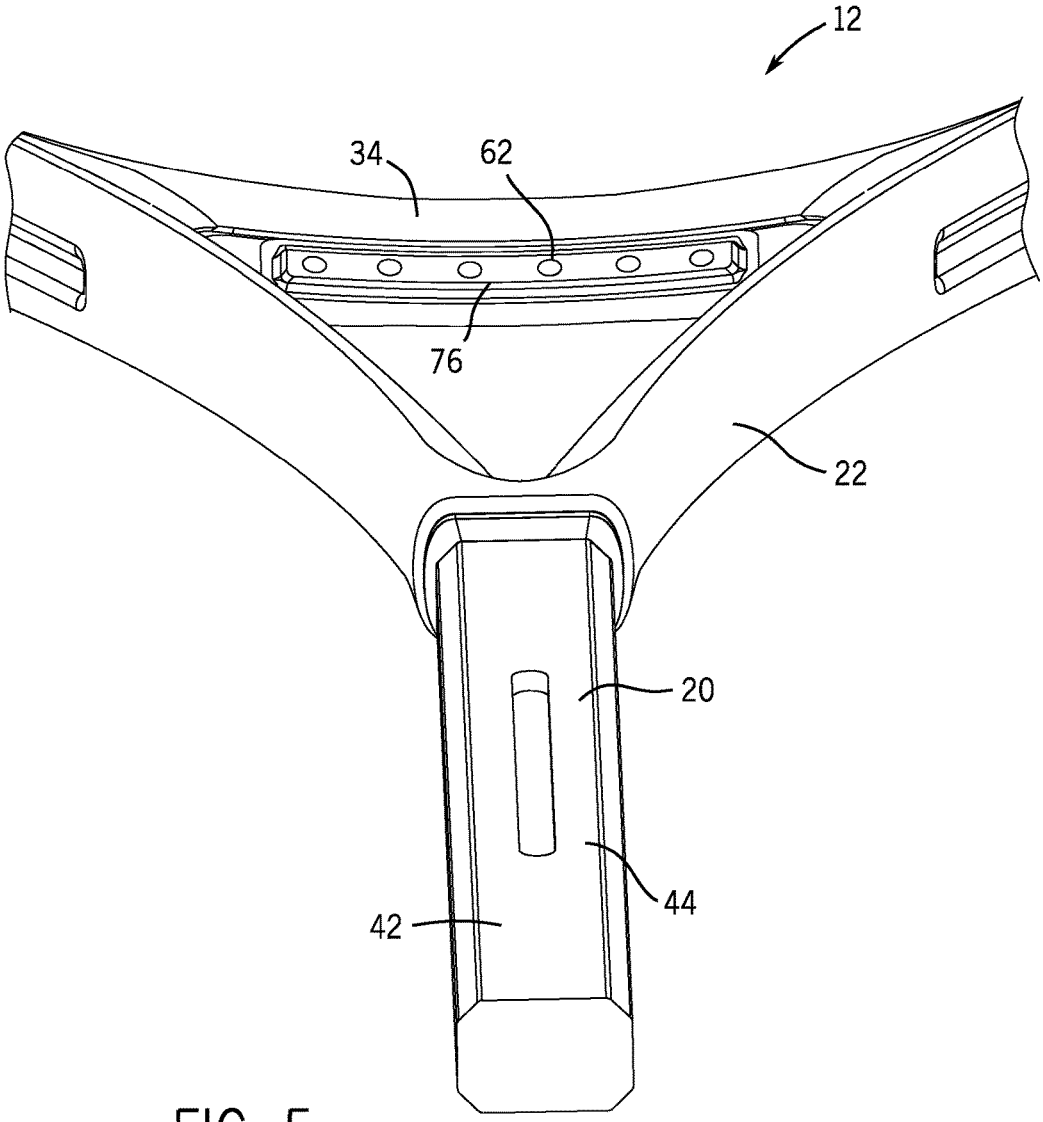
FIG. 5 is a bottom side perspective view of a portion of the throat portion the racquet of FIG. 1 without the string support assembly.

Referring to FIGS. 2 through 5, the proximal region 30 of the head portion 18 can include a channel 76 for receiving the grommet structure 72. The channel 76 is preferably sized and shaped to provide a smooth transition between the grommet structure 72 and the outer surfaces of the proximal region 30. Referring to FIG. 5, the frame 12 of the racquet 10 is illustrated without the string support structure and string. The channel 76 is illustrated along with the grommet openings 62 positioned through a recessed surface of the proximal region 34 defining the channel 76.

Referring to FIGS. 3, 6*a*, 7 and 6-8, the grommet structure 72 is a base structure positioned within the channel 76 and the grommet openings 62 of the proximal region 30. The grommet structure 72 includes a first strip 78 having a first inner surface 80 and six spaced apart barrels 82 extending from the inner surface 80. In one implementation, the grommet structure 72 is retained to the frame 12 by the racquet string 50 extending through the grommet structure 72 and the proximal region 30, and by the barrels extending through the grommet openings 76. In another implementation, the grommet structure 72 can be attached to proximal region 30 at the channel 76 through an interference or press-fit. In another implementation, the grommet structure 72 can be secured to the proximal region 30 through an adhesive or other fastening means. In other implementations, the number of spaced apart barrels can be two, four (FIG. 6*c*), eight (FIG. 6*d*), ten or more, and the length and size of the first strip can be adjusted to accommodate the different number of barrels.

Each barrel 82 includes a string hole 84 through the length of the barrel 82 along a longitudinal barrel axis 94. The barrel 82 is configured to protect the racquet string 50 as it extends through the grommet openings 62 of the outer and inner peripheral walls 58 and 60 of the proximal region 30 of the frame 12. Each barrel 82 is sized to extend through one of the grommet openings 62, and the string hole 84 is sized to receive racquet string. In one implementation, the barrels 82 are integrally formed with the first strip 78 such that one cannot be removed from the other without destructively damaging one or both of the first strip 78 or the barrel 82. In other implementations, the barrels can be coupled to the first strip by other means, such as, adhesive bonding, thermal bonding, press-fit connection, tongue-and-groove connection, threaded engagement or other fastening means. The grommet structure 72 is preferably formed of a lightweight, durable and resilient material, such as a thermoplastic nylon. Alternatively, the grommet structure 72 can be formed of other materials, such as, for example, a composite material, a urethane, a polyamide, a rubber, wood, aluminum, other metals, other thermoplastic materials and combinations thereof.

The first strip 78 includes a set of bearing element openings 86 for removably and/or releasably engaging one or more of the bearing elements 74. In one implementation, the openings 86 are sized and shaped to provide a press fit releasable engagement with the bearing elements 74. In other implementations, the bearing elements can be fixedly secured to the strip 78 through adhesive bonding, thermal bonding, press-fit connection, tongue-and-groove connection, threaded engagement or other fastening means. In other implementations, the elements can be releasably coupled to the first strip one or more fasteners.

Figure 6A:
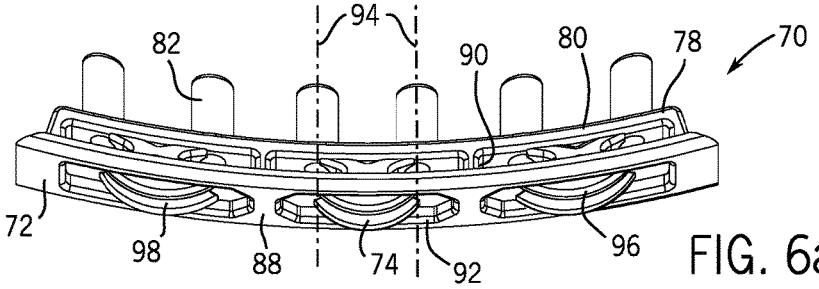
FIG. 6*a* is front, bottom perspective view of an implementation of a string support assembly.
Figure 6B:
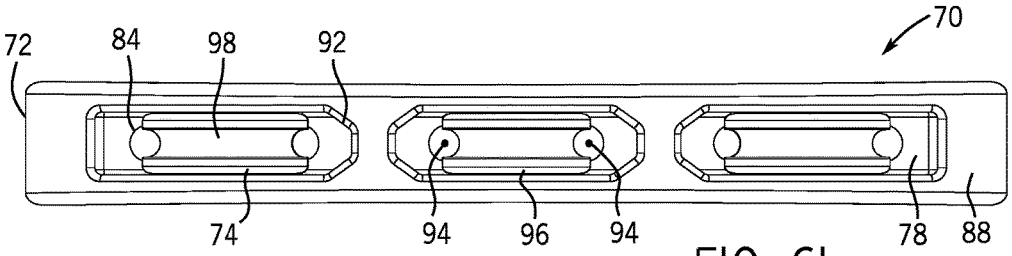
FIG. 6*b* is a bottom view of the string support assembly of FIG. 6*a*.
Figure 6C:
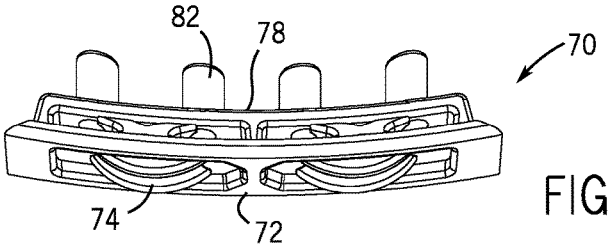
FIG. 6*c* is front, bottom perspective view of another implementation of a string support assembly.
Figure 6D:
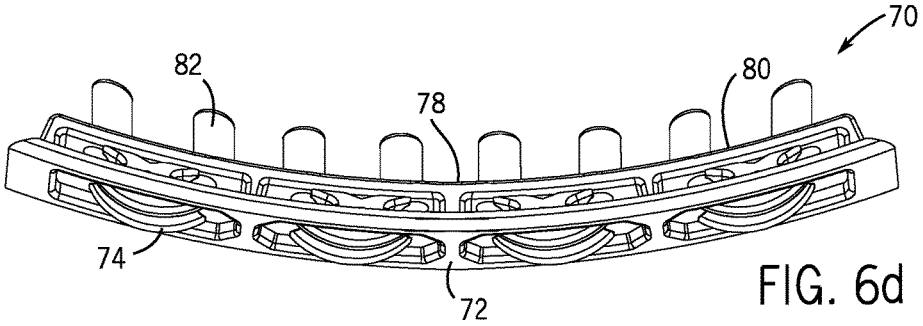
FIG. 6*d* is front, bottom perspective view of another implementation of a string support assembly.
Figure 7:
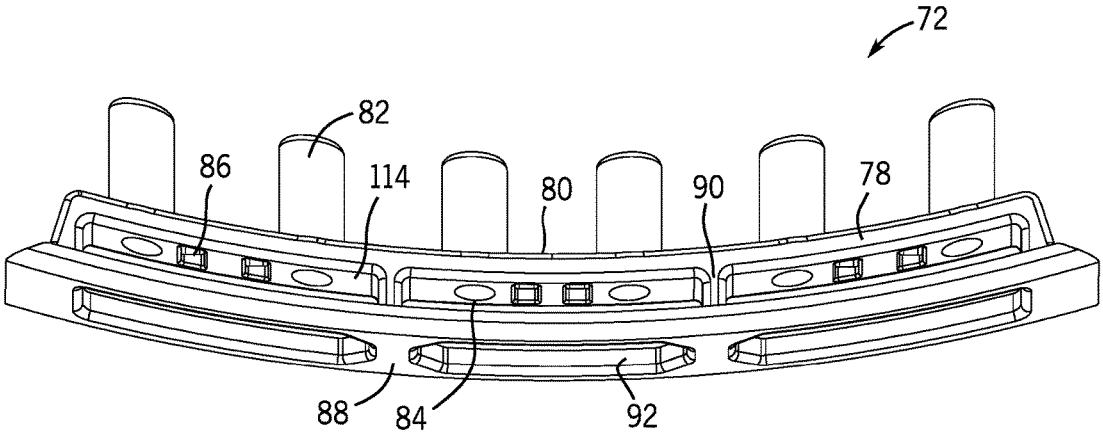
FIG. 7 is a front, bottom perspective view of a grommet structure of the string support assembly of FIG. 6*a*.
Figure 8:
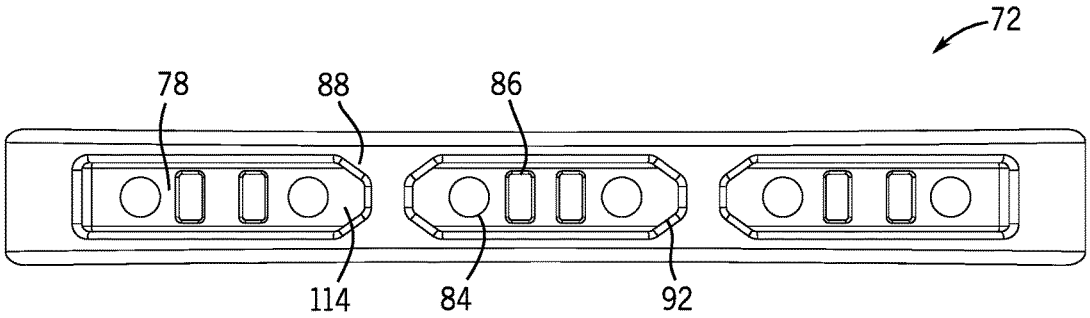
FIG. 8 is a bottom view of the grommet structure of FIG. 7.
Figure 9:
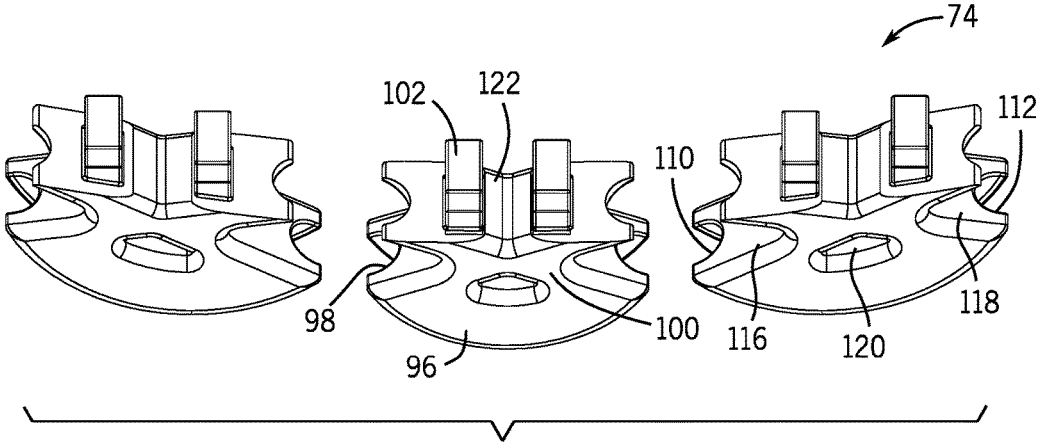
FIG. 9 is a side perspective view of a set of bearing elements of the string support assembly of FIG. 6*a*.

The grommet structure 72 can further include a second strip 88 that is spaced apart from the first strip 78 by one or more tabs 90. The first and second strips 78 and 88 and the tabs 90 can be integrally formed as one body. In other implementations, the one or more of the first strip, the second strip and the tabs can be separate structures that are connected to each other through an adhesive, bonding, threaded connections, press-fit connections, one or more fasteners or other fastening means. The second strip 78 includes one or more elongate slots 92 from receiving the bearing element(s) 74. The slots 92 are sized to surround the bearing element 74 when the element 74 is attached to the first strip 78 and to receive the string 50 extending through the barrels 82 and engaging the bearing elements 74. In the implementation of FIG. 6*a*, the second strip 88 includes three spaced apart elongate slots 92. In other implementations, the second strip 88 can include a single slot, two slots (FIG. 6*c*), four slots (FIG. 6*d*) or more. The second strip 88 and the tabs 90 provide additional strength to the grommet structure 70 and enable the grommet structure 70 to fit within the channel 76 of the proximal region 30.

Referring to FIGS. 3, 6*a*, 9, 10*a* and 11, the bearing elements 74 are shown in greater detail. Each bearing element 74 is coupled to the first strip 78 and is generally positioned between two longitudinal barrel axes 94 of adjacent barrels 82 of the grommet structure 72. The bearing element 74 is a resilient, durable string guide configured to support and redirect the path of the string 50 from one barrel 82 and around to an adjacent barrel 82. The bearing element 74 is preferably formed of a lightweight, durable and resilient material, such as a polyamide (Nylon®) material. Alternatively, the bearing element 74 can be formed of one or more other materials, such as, for example, a urethane, an elastomer, a rubber, PEBAX®, other thermoplastic materials and combinations thereof. The material used to form the bearing element 74 has a durometer within the range of 50 to 90 on the Shore D hardness scale. In one implementation, the durometer of the material of the bearing element 74 is at least 10 increments below (or 10 increments softer than) the durometer of the material used to form the grommet structure on the Shore D hardness scale. In one implementation, the material of the grommet structure has a durometer between 60 and 90 on the Shore D hardness scale and the material of the bearing element 74 has a durometer between 50 and 80 on the Shore D hardness scale.

The bearing element 74 includes an upper portion 96 having a curved, grooved rim 98 and a lower portion 100 coupled to the first strip 78. The lower portion 100 can include two outwardly extending projections 102 for engaging the bearing element openings 86 of the first strip 78. In other implementations, other numbers, sizes, shapes and configurations of the projections can be used. In other implementations, the bearing element can be formed without one or more projections. The bearing element 74 is releasably coupled to the first strip 78 through the projections 102. In other implementations, the bearing elements 74 can be fixedly or removably attached to the first strip through other fastening means.

The curved grooved rim 98 of the upper portion 96 of the bearing element 74 generally extends about or in line with the string bed plane 54. The curved grooved rim 98 of the upper portion 96 forms an arc for supporting the string 50 as the string curves or turns from one barrel 82 to an adjacent barrel 82. The racquet string used to form the string bed 14 is redirected to extend in the opposite direction to form another main string segment 50 (or cross-string segment 52) of the string bed 14. As a result, the string takes a path that results in a turn of approximately 180 degrees. In one implementation, the rim 98 forms an arc that supports the string 50 over at least 60 degrees of string path change or routing change. In other implementation, the rim 98 supports the string over at least 90 degrees of string path change or routing change. In other implementations, the rim can form an arc that supports the string over a path change of at least 120 degrees.

The curved rim 98 has opposite first and second ends 110 and 112 which are spaced apart from an outer surface 114 of the first strip 78 by a predetermined dimension. In one implementation, the first and second ends 110 and 112 are spaced apart from the outer surface 114 of the first strip 78 by at least 5 mm. In another implementation, the first and second ends 110 and 112 are spaced apart from the outer surface 114 of the first strip 78 by at least 10 mm.

The lower portion 100 of the bearing element 74 includes a pair of opposing cutouts 116 and 118, which are positioned between the first and second ends 110 and 112, respectively, and the outer surface 114 of the first strip 78. In one implementation, the cutouts 116 and 118 are generally V-shaped. The lower portion 100 further includes a through bearing element passage 120 generally positioned between the cutouts 116 and 118, and a generally V-shaped base recess 122 positioned generally between the projections 102. The cutouts 116 and 118, the passage 120, and/or the recess 122 facilitate the deflection, compression and/or resiliency of the bearing element 74. The deflection, compression and/or resiliency of the bearing element 74 can be adjusted based upon the properties of the material or materials used for the bearing element and the size, shape and/or number of cutouts 116 and 118, the passage 120 and/or the recess 122. The deflection, compression and/or resiliency of the bearing elements 74 enables the racquet string 50 engaged with the rim 98 to move closer to the hoop of the head portion 18 thereby allowing the associated string 50 to deflect to a greater extent upon impacting a ball than a racquet without the bearing elements 74.

Figure 10A:
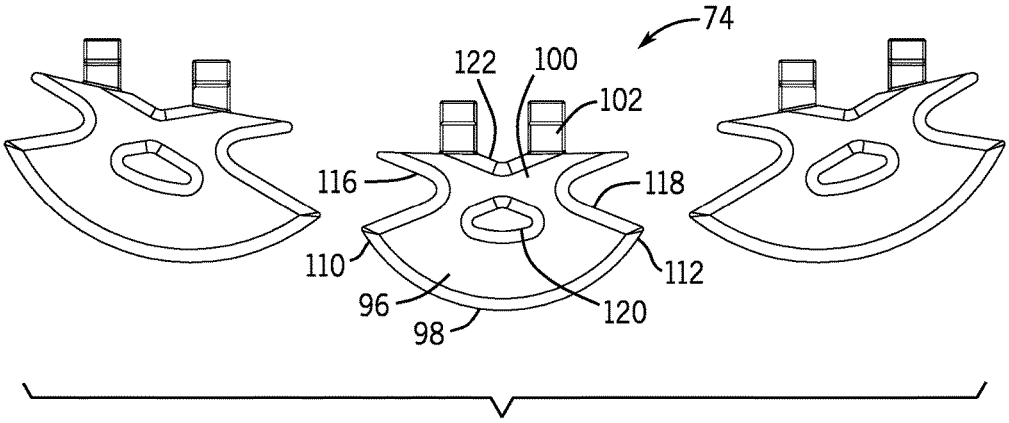
FIG. 10*a* is a front view of the set of bearing elements of FIG. 9.
Figure 10B:
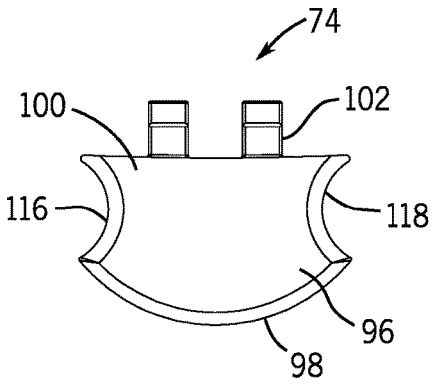
FIG. 10*b* is a front view of a bearing element in accordance with another implementation of the present invention.
Figure 10C:
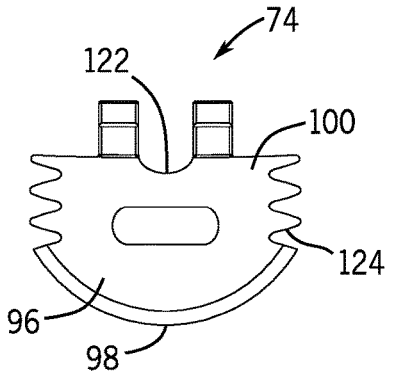
FIG. 10*c* is a front view of a bearing element in accordance with another implementation of the present invention.

Referring to FIG. 10*b* in another implementation of the bearing element 74 is illustrated. The cutouts 116 and 118 can be generally C-shaped, and the bearing element can be formed without the passage and the recess. In other implementations, the bearing element can be formed with only one of the passage or the recess. In other implementations, the cutouts can take other shapes. Referring to FIG. 10*c* in another implementation, a plurality of cutouts 124 can be formed on each end of the lower portion 100 of the bearing element 74 in lieu of the pair of cutouts 116 and 118. Additionally, the passage 120 can have an ovular shape and the recess 122 can have a C-shape. In other implementations, the number, size and shape of the cutouts can be varied, and the shape and size of the passage and/or the recess can be varied. The existence or absence of the passage and/or the recess, and the size, quantity and/or shape of the cutouts can vary the resiliency or ability of the bearing element to deflect or compress upon impact of the string supported by the string support assembly 70 with a ball.

Figure 10D:
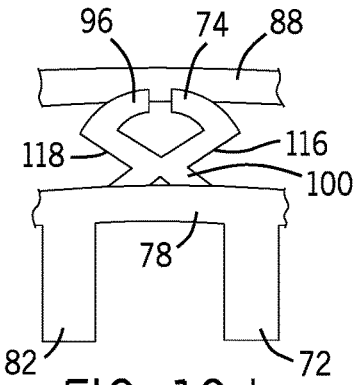
FIGS. 10*d* through 10*i* are front sectional views of a string support assembly including one bearing element in accordance with alternative implementations of the present invention.
Figure 10E:
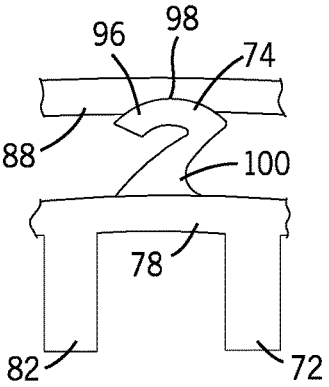
Figure 10F:
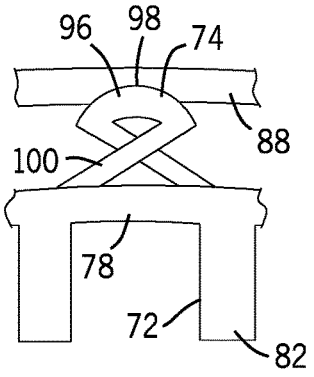
Figure 10G:
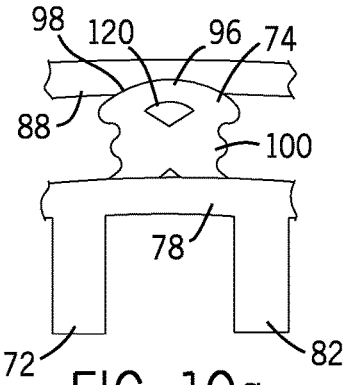
Figure 10H:
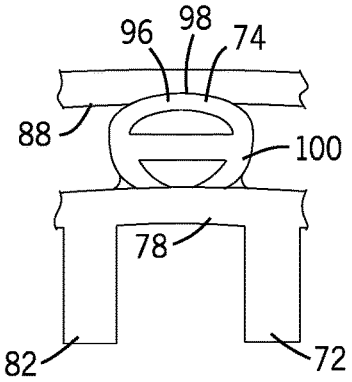
Figure 10I:
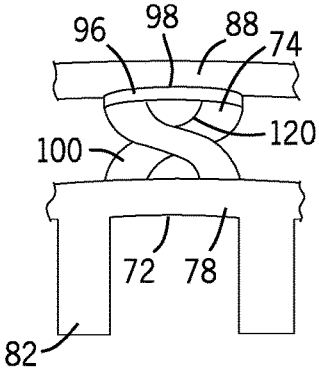
Figure 11:
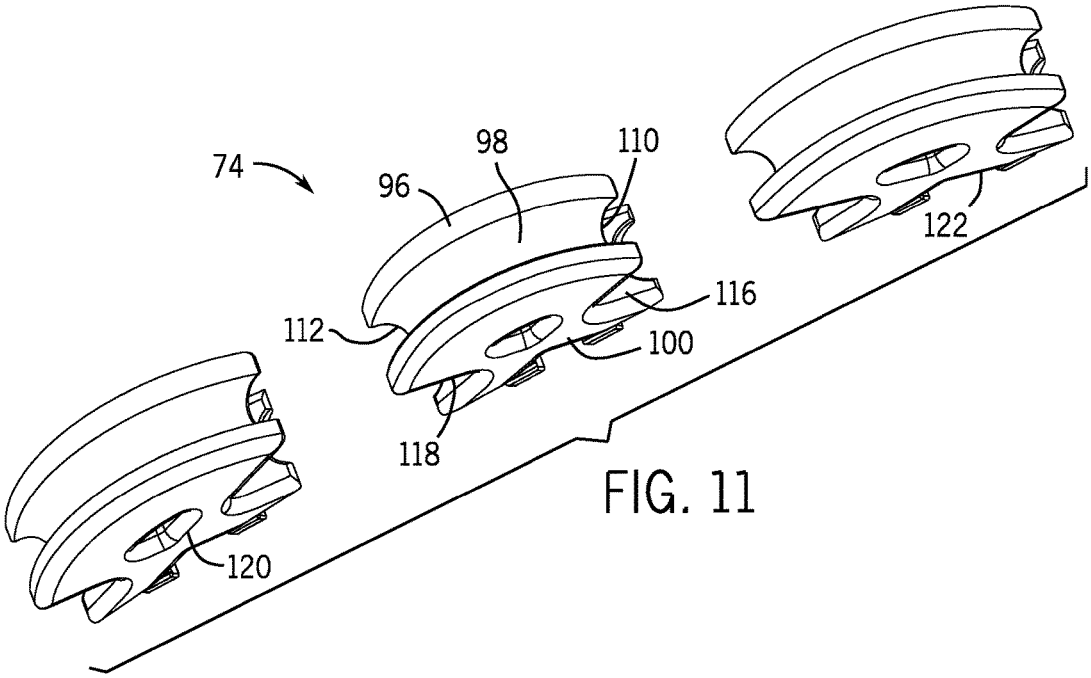
FIG. 11 is a bottom perspective view of the set of bearing elements of FIG. 9.

Referring to FIGS. 10*d* through 10*i*, alternative implementations of the string support assembly 70 are illustrated. In particular, a sectional front view of a portion the string support assembly 70 is shown with different configurations of the bearing element 74. In the implementation of FIG. 10*d*, the bearing element 74 is generally X-shaped with a pair of curved rim elements forming the upper portion 96 and the rim 98 and the cutouts 116 and 118 are generally V-shaped. In the implementation of FIG. 10*e*, the bearing element 74 has an upper portion 96 forming the rim 98 and the lower portion 100 of the bearing element 74 is a single continuous curved member extending from the first strip 78 and attaching to one end of the upper portion 96. In the implementation of FIG. 10*f*, the upper portion 96 forms the curved rim 98 and the lower portion 100 is a pair of criss-crossing legs extending from the first strip 78. Referring to FIG. 10*g*, the lower portion 100 of the bearing element 74 includes a plurality of cutouts and a generally triangular shaped passage 120. In the implementation of FIG. 10*h*, the upper portion 96 of the bearing element 74 forms the curved rim 98 and the lower portion 100 has generally circular shape with a pair of passages. The implementation of FIG. 10*i* provides a flatter or more horizontal curved rim 98 of the upper portion 96 and a lower portion 100 includes a pair of criss-crossing curved legs that give the lower portion 100 a general hour glass shape.

Figure 12:
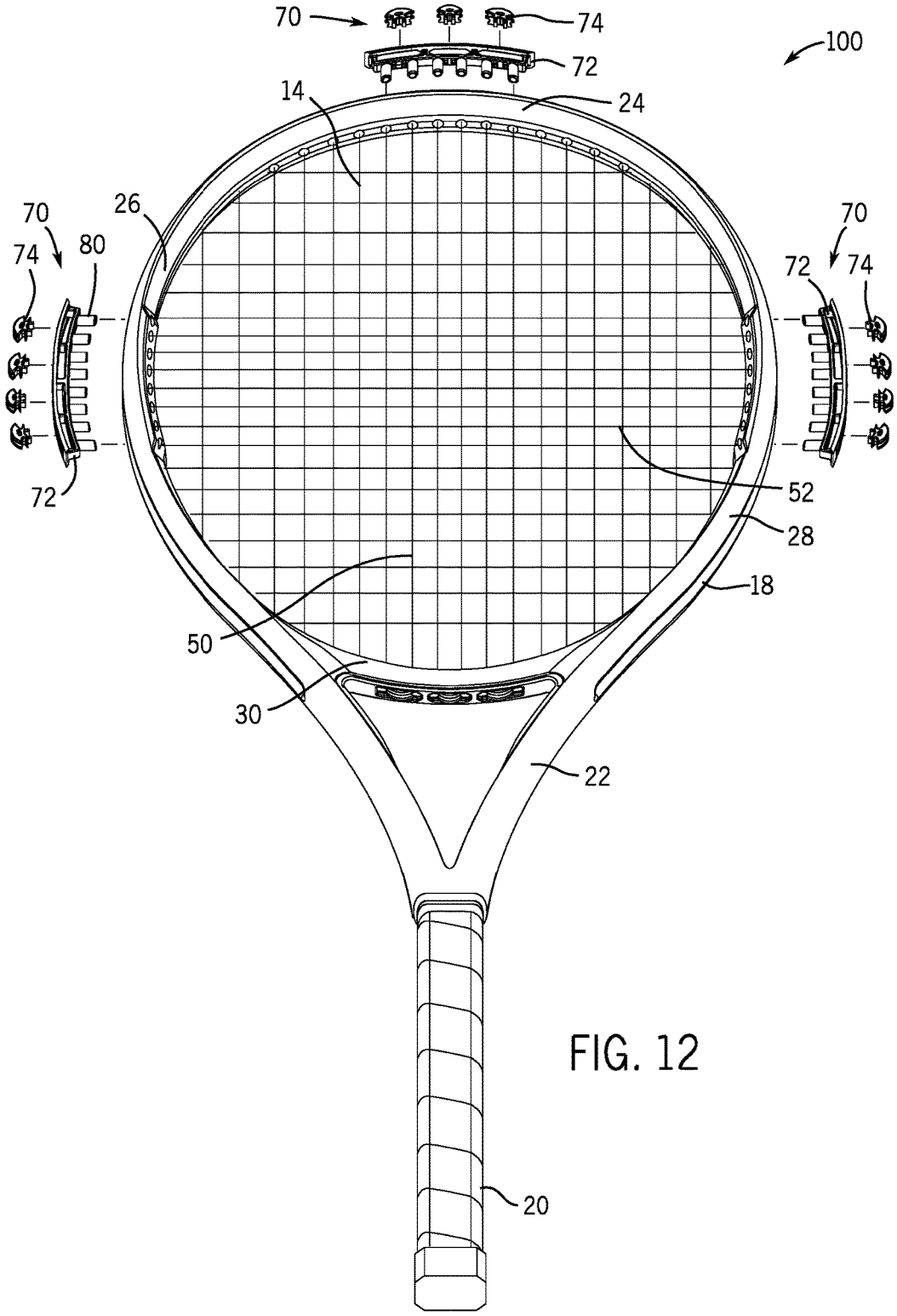
FIG. 12 is a front, bottom perspective view of a racquet in accordance with another implementation of the present invention.

Referring to FIG. 12, in another implementation, a racquet 100 can be formed with string support assemblies 70 positioned at the distal region 24, the first and second side region 26 and 28 and the proximal region 30 of the head portion 18. The string support assemblies 70 can vary in size from one location to the other. The string support assemblies 70 positioned at the first and second side regions 26 and 28, or at the 3 and 9 o'clock positions, of the head portion 18 support cross-string segments 52. The string support assemblies 70 increase the responsive and performance of the racquet 100 by enabling the main string segments 50 and the cross-string segments 52 engaging the string support assemblies 70 to readily deflect, to a greater extent than a racquet formed without the string support assemblies 70. The example implementation of FIG. 12 shows the string support assemblies 70 at the first and second side regions 26 and 28 each including four separate bearing elements 74, and the string support assemblies at the distal region 24 and the proximal region 30 each including three separate bearing elements 74. In other implementations, the string support assemblies 70 can be sized to support other numbers of bearing elements. In other implementations, the racquet 10 or 100 can be formed with string support assemblies 70 positioned at any one or more of the distal region, the first and second side regions and the proximal region of the head portion.

In an effort to measure the increase in performance, or the coefficient of restitution ("COR") of the string bed 14, of a racquet 10 that incorporates the string support assembly 70 in the proximal region 30 a mapping of the areas of various COR values for a control racquet, an Ultra® 100 Countervail® model racquet produced by Wilson Sporting Goods Co. of Chicago, Ill., and the racquet 10 having the same construction as the control racquet but also includes the string support structure 70 at the proximal region 30 of the head portion 18 of the racquet 10 was completed. Each of the racquets had the same racquet construction including head size of 100 sq. in. and shape, but the prior art control racquet was formed without the string support assembly.

The COR is the ratio of the rebound velocity of a ball, such as, for example, a tennis ball, to the incoming velocity of the ball. The COR values were measured by using an incoming velocity of 90 feet per second, +/−5 feet per second. Each mapping reflects the COR values resulting from the impacts of the ball with the string bed at numerous, distributed locations about the string bed. The mapping was obtained from taking COR measurements at 36 different locations on the string bed 14 of the racquet, wherein each location is impacted 5 times for a total of 180 data points per racquet. The racquet is supported in the test apparatus only at the handle. In particular, the test apparatus secures the proximal end of the handle (approximately the proximal 6 inches of the handle). The attachment of the test apparatus to the racquet restricts the proximal end of the handle from moving or twisting along the x, y or z axes. Each racquet included the same type of racquet string, a synthetic gut string, strung at a string tension of 55 lbs tension, when measured in a strung condition generally at the center of the string bed.

The numerical values of the COR areas for the racquets mapped are provided in Table 1 below. The row of Table 1 labeled 0.40 represents the area on the string where the COR was 0.40 or greater. The row of Table 1 labeled 0.39 represents the area on the strings where the COR was 0.39 or greater. Similarly, the other rows of Table 1 represent the areas on the strings for various values of COR. Upon reviewing Table 1, it is apparent that COR values of 0.40 or greater do not exist on the control racquet because the control racquet never reached a COR reading of 0.40. The racquet 10 of the present invention does include an area where the performance reached a COR reading of 0.40. The maximum COR reading for the control racquet was 0.39 and the maximum COR of racquet 10 of the present invention was 0.40. The area of the string bed having a COR of 0.39 or higher was 16 percent greater on the racquet 10 of the present invention than the control racquet of FIG. 13. The area of the string bed having a COR of 0.35 or higher was 4 percent greater on the racquet 10 of the present invention than the control racquet.

Table 1 below summarizes the COR data provided of the control racquet and the racquet incorporating the present invention.

TABLE 1

COMPARISON OF COR AREAS FOR RACQUET 10 OF PRESENT INVENTION WITH A CONTROL RACQUET

Figure 13:
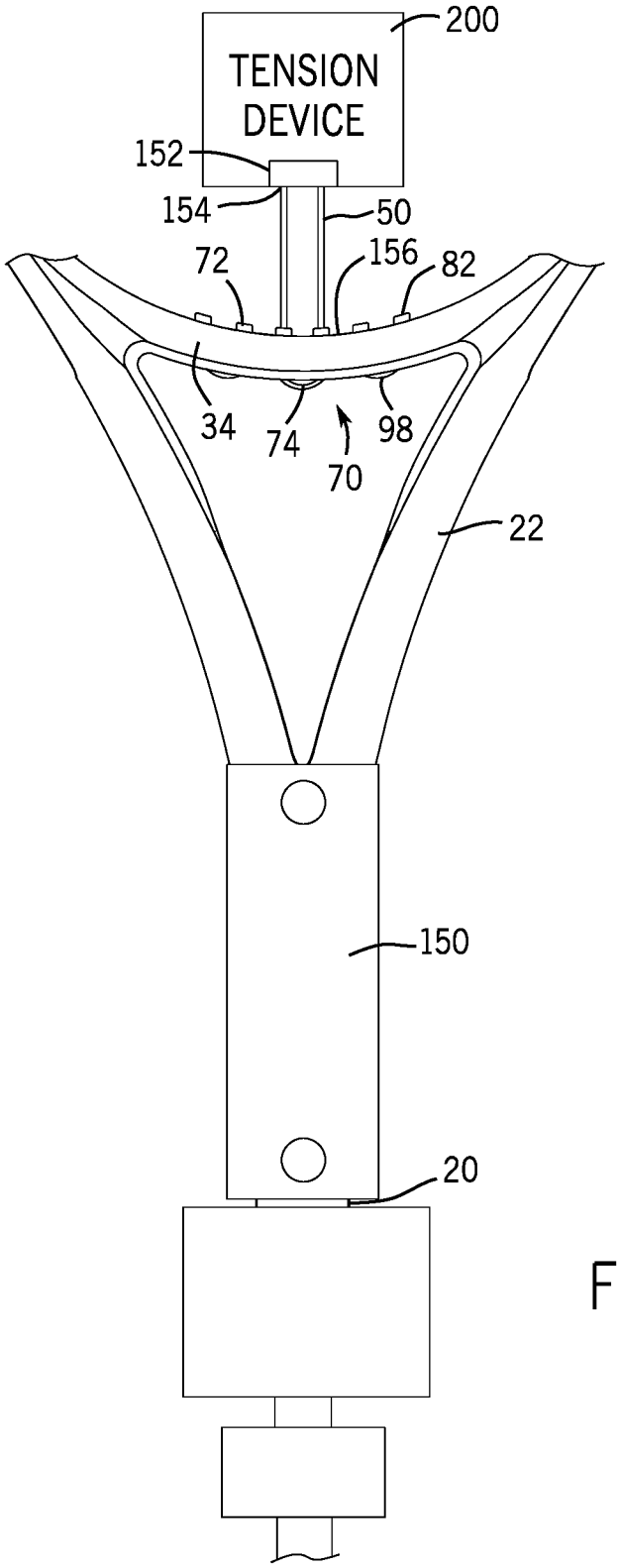
FIG. 13 is a front view of a representation of a string deformation or extension test including a string segment extending through a racquet yoke and coupled to a tension device.

| COR | CONTROL RACQUET OF FIG. 13 SQ. INCHES | RACQUET OF PRESENT INVENTION (FIG. 14) SQ. INCHES | % DIFFERENCE |
|---|---|---|---|
| 0.40 | 0.00 | 0.699 | |
| 0.39 | 1.598 | 1.847 | 16 |
| 0.37 | 5.991 | 6.241 | 4 |
| 0.35 | 9.436 | 9.860 | 4 |
| 0.33 | 12.706 | 13.006 | 2 |
| 0.30 | 17.549 | 17.674 | 1 |

Tables 2 and 3 illustrate the results of a string deformation test performed on (1) a control racquet yoke having a conventional grommet positioned within the string holes of the yoke, and (2) a racquet yoke that includes the string support assembly 70. FIG. 13 generally represents the test arrangement of the string deformation test on a yoke 34 of a racquet including a string support assembly 70. The handle portion 20 is fixedly coupled to a first support 150 or test fixture of a universal test machine 200. A segment or piece of racquet string 50 is routed through adjacent barrels 82 and around the rim 98 of one of the bearing elements 74. The string is aramid fiber 17 gage aramid fiber racquet string, such as an Ashaway® Kevlar® 17 g racquet string. The ends 154 of the segment of string 50 are secured to a string clamp 152 of the universal test machine 200, which can be an Instron® universal test machine, Model 5581 including a load cell. The distance from a top surface 156 of the yoke 34 (the surface forming part of the hoop of the head portion of the racquet) to the string clamp 152 used to clamp the ends 154 of the string segment 50 is 3 inches or 76.2 mm. The string 50 is then pre-loaded by the universal test machine 200 to a value of 55 lbf. Then, the load (or tension) placed on the segment of string 50 is increased to a value of 95 lbf, and the deformation or extension of the string 50 is measured between the tensile load of 55 lbf and the tensile load of 95 lbf. The test of the yoke 34 with the string support assembly 70 was then repeated five more times to obtain a total of six string extension values, which were then averaged. The test was also performed five times on the control racquet yoke having a conventional string grommet, with the results averaged. Instead of the string segment extending through the grommet structure and about one of the bearing elements of the string support assembly 70, the string segment 50 is routed through a pair of adjacent grommet barrels and around an outer surface of the conventional grommet. The string deformation or extension test was then performed five times and the extension or deformation of the string 50 from the 55 lbf load to the 95 lbf load was recorded.

TABLE 2

COMPARISON OF STRING DEFORMATION OR EXTENSION FOR RACQUET 10 OF PRESENT INVENTION AND A CONTROL RACQUET

| YOKE TYPE/TEST NO. | STRING DEFORMATION OR EXTENSION (mm) |
|---|---|
| Control Yoke, No. 1 | 0.70444 |
| Control Yoke, No. 2 | 0.7066 |
| Control Yoke, No. 3 | 0.70606 |
| Control Yoke, No. 4 | 0.70251 |
| Control Yoke, No. 5 | 0.70368 |
| AVERAGE | 0.70466 |
| Yoke with String Support Assembly, No. 1 | 0.80308 |
| Yoke with String Support Assembly, No. 2 | 0.80375 |
| Yoke with String Support Assembly, No. 3 | 0.7988 |
| Yoke with String Support Assembly, No. 4 | 0.80368 |
| Yoke with String Support Assembly, No. 5 | 0.7836 |
| Yoke with String Support Assembly, No. 6 | 0.80856 |
| AVERAGE | 0.80025 |

When the string support assembly 70 is engaged with the yoke 34 and the string segment 50 is routed through two of the spaced apart barrels 82 and about the rim 98 of one of the bearing elements 74, the handle portion is fixed to the first test support 150, the ends 154 of the string segment 50 are secured by the string clamp 152 such that the string segment extends a length of 3 inches or 76.2 mm from the top peripheral surface 156 of the yoke 34 to the string clamp 152 of the universal test machine 200, and the string segment 50 is placed under tension by the universal test machine 200 from a starting tension of 55 lbf to final tension of 95 lbf, the string segment 50 extends by at least 0.75 mm. The extension of the string 50 essentially reflects the compression and/or deflection of the string support assembly 70 or of the conventional grommet assembly. The increase of the length of the segment of the racquet string 50 extending through the yoke 34 under a 95 lbf tension load compared to the length of the segment of string extending through the yoke under a 55 lbf tension load represents or corresponds to a change to the effective length of the string which can significantly improve the performance of the racquet. A review of data of Table 2 illustrates that the segment of string 50 extending through the yoke 34 and through and about a string support assembly 70 demonstrated significantly greater extension of the string 50 than the segment of string extending through the yoke formed with a conventional grommet. The bearing element 74 of the string support assembly 70 compresses and/or deflects with respect to the yoke 34 when the segment of string is placed under tension, thereby enabling the string wrapping around rim of the bearing element 74 and extending through the barrels 82 of the grommet structure 72 to extend further when under tension than the control racquet formed without the string support assembly 70. The increased string deflection and/or extension can represent increased deflection of the string 50 upon impacting a ball which will lead to increased performance, dwell time and control.

The deflection, compression and/or resiliency of the bearing element 74 with respect to the grommet structure 72 and/or the head portion 18 enables the string engaged with the string support assembly 70 to deflect or extend further upon impact with the ball and thereby provide more responsiveness and greater power transfer to the ball. Further, the increased deflection of the string bed 14 increases the "dwell time," or the duration of contact between the ball and the string bed 14 of the racquet 10 upon contact, enabling the user to impart spin more easily to the ball and to achieve better overall control of the ball during play. The incorporation of the present invention significantly improves the racquet's performance by increasing the effective length of the applicable string segments. The present invention provides this significant advantage without requiring an increase in the size of the head portion and the corresponding undesirable increase in the polar moment of inertia of the racquet. The present invention allows for a wide range of potential arrangements and configurations of the string support assemblies on or about the head portion of a racquet, thereby maximizing the flexibility of the racquet design and allowing the racquet to be customized or tailored to meet the needs of a particular player or type of player.

While the preferred embodiments of the present invention have been described and illustrated, numerous departures therefrom can be contemplated by persons skilled in the art. Therefore, the present invention is not limited to the foregoing description but only by the scope and spirit of the appended claims.

What is claimed is:

1. A racquet string support assembly for a sports racquet, the sports racquet including a frame having a plurality of grommet holes and at least one racquet string, the string support assembly comprising:

a grommet structure including a first strip having a first inner surface for contacting the frame and a first outer surface, and at least two spaced-apart barrels extending from the first inner surface, each barrel including a first string hole extending along a longitudinal axis of the barrel, each barrel configured to extend through a separate one of the grommet holes of the frame; and at least one bearing element coupled to the grommet structure, the bearing element including an upper portion having a curved grooved rim forming an arc for engaging a portion of the racquet string and a deflectable lower portion having a pair of opposing cutouts to facilitate deflection of the bearing element.

2. The racquet string support assembly of claim 1, wherein the at least one bearing element is removably coupled to the grommet structure.

3. The racquet string support assembly of claim 1, wherein the at least one bearing element includes at least one projection outwardly extending from the lower portion of the bearing element, and wherein the grommet structure includes at least one opening for engaging the at least one projection.

4. The racquet string support assembly of claim 1, wherein the at least one bearing element is fixedly attached to the grommet structure.

5. The racquet string support assembly of claim 1, wherein the arc formed by the curved grooved rim changes the path or direction of the string segment engaging the rim by at least 60 degrees.

6. The racquet string support assembly of claim 5, wherein the rim changes the path or direction of the string segment engaging the rim by at least 90 degrees.

7. The racquet string support assembly of claim 1, wherein the frame of the racquet includes a hoop, wherein the at least one string forms a string bed within the hoop, wherein the string bed generally extends about a string bed plane, and wherein the grooved rim extends about the string bed plane.

8. The racquet string support assembly of claim 7, wherein the bearing element is positioned substantially between the longitudinal axes of the two spaced-apart barrels.

9. The racquet string support assembly of claim 1, wherein grooved rim of the bearing element includes a first end and a second end, and wherein the first and second ends are spaced apart from the outer surface of the first strip by a predetermined first dimension.

10. The racquet string support assembly of claim 9, wherein the predetermined first dimension is at least 5 millimeters.

11. The racquet string support assembly of claim 1, wherein the grommet structure further includes a second strip outwardly spaced apart from the first strip.

12. The racquet string support assembly of claim 11, wherein the second strip is spaced apart from the outer surface of the first strip by a plurality of tabs, and wherein the second strip includes at least one elongated aperture for receiving the at least one bearing element.

13. The racquet string support assembly of claim 1, wherein the grommet structure includes at least four spaced-apart barrels and wherein the at least one bearing element is at least two bearing elements.

14. The racquet string support assembly of claim 1, wherein the grommet structure includes at least six spaced-apart barrels and wherein the at least one bearing element is at least three bearing elements.

15. The racquet string support assembly of claim 7, wherein the hoop of the racquet includes a top region, a bottom region, a first side region and a second side region, and wherein the string support assembly is positioned at one of the top, bottom, first side and second side regions of the hoop of the racquet.

16. The racquet string support assembly of claim 1, wherein the pair of opposing cutouts of the deflectable lower portion of the bearing element are generally V-shaped cutouts, and wherein the V-shaped cutouts are positioned between the grooved rim of the upper portion of the bearing element and the outer surface of the first strip of the grommet assembly.

17. The racquet string support assembly of claim 1, wherein the deflectable lower portion of the bearing element includes a passage positioned between the first and second cutouts.

18. A sports racquet for supporting at least one racquet string, the racquet comprising:

a frame including a handle portion and a head portion separated by a pair of throat tubes, the head portion having a plurality of grommet holes, and including a top region, a bottom region, a first side region and a second side region;

at least one string support assembly including;

a grommet structure including a first strip having a first inner surface for contacting the frame and a first outer surface, and at least two spaced-apart barrels extending from the first inner surface, each barrel including a string hole extending along a longitudinal axis of the barrel, each barrel configured to extend through a separate one of the grommet holes of the frame; and at least one bearing element coupled to the grommet structure, the bearing element including an upper portion having a curved grooved rim forming an arc for engaging a portion of the racquet string and a deflectable lower portion having a pair of opposing cutouts to facilitate deflection of the bearing element;

wherein the at least one string support assembly is positioned at one or more of the top portion, the bottom portion, the first side portion and the second side portion of the head portion of the frame.

19. The sports racquet of claim 18, wherein the at least one string support assembly is at least two string support assemblies positioned at least two of the top portion, the bottom portion, the first side portion and the second side portion of the head portion.

20. The sports racquet of claim 18, wherein the at least one string forms a string bed within a hoop formed by the head portion, wherein the string bed generally extends about a string bed plane, wherein the grooved rim extends about the string bed plane, wherein the bearing element is positioned substantially between the longitudinal axes of the two spaced-apart barrels, wherein grooved rim of the bearing element includes a first end and a second end, and wherein the first and second ends are spaced apart from the outer surface of the first strip by a predetermined first dimension.

21. A string support assembly configured for attachment to a sports racquet having a yoke and a handle portion wherein the yoke includes a plurality of grommet holes and a top peripheral surface, the string support assembly and the yoke supporting a segment of 17 gage aramid racquet string, the yoke, the string support assembly and the string segment capable of being tested under a string deformation test using a universal test machine including a first support and a string clamp, the string support assembly comprising:

a grommet structure including a first strip having a first inner surface for contacting the yoke and a first outer surface, and at least two spaced-apart barrels extending from the first inner surface, each barrel including a string hole extending along a longitudinal axis of the barrel, each barrel configured to extend through a separate one of the grommet holes of the yoke; and at least one bearing element coupled to the grommet structure, the bearing element including an upper portion having a curved grooved rim forming an arc for engaging a portion of the racquet, wherein, when the string support assembly is engaged with the yoke and the string segment is routed through two of the spaced apart barrels and about the rim of one of the bearing elements, the handle portion is fixed to the first test support, the ends of the string segment are secured by the string clamp such that the string segment extends a is length of 76.2 mm from the top peripheral surface of the yoke to the string clamp of the universal test machine, and the string segment is placed under tension by the universal test machine from a starting tension of 55 lbf to final tension of 95 lbf, the string segment extends by at least 0.75 mm.

* * * * *